US008122649B2

(12) United States Patent
Thomas

(10) Patent No.: US 8,122,649 B2
(45) Date of Patent: Feb. 28, 2012

(54) INTERLOCKING TILES EMPLOYING ADJUSTABLE RAIN LOCK

(75) Inventor: Derek P. Thomas, Lancaster, OH (US)

(73) Assignee: Ludowici Roof Tile, New Lexington, OH (US)

( * ) Notice: Subject to any disclaimer, the term of this patent is extended or adjusted under 35 U.S.C. 154(b) by 216 days.

(21) Appl. No.: 12/078,872

(22) Filed: Apr. 7, 2008

(65) Prior Publication Data

US 2009/0249729 A1 Oct. 8, 2009

(51) Int. Cl.
*E04D 1/20* (2006.01)

(52) U.S. Cl. ..... 52/100; 52/533

(58) Field of Classification Search ..... 52/98, 100, 52/532, 533, 534
See application file for complete search history.

(56) References Cited

U.S. PATENT DOCUMENTS

| | | | | | |
|---|---|---|---|---|---|
| 1,583,969 | A | * | 5/1926 | Greenstreet | 52/531 |
| 1,597,993 | A | | 8/1926 | Meurer | |
| 1,604,745 | A | * | 10/1926 | Finley | 52/527 |
| 1,743,206 | A | | 1/1930 | Fuldenwider et al. | |
| 1,802,868 | A | * | 4/1931 | Black | 52/545 |
| 1,826,082 | A | * | 10/1931 | Mastick | 52/519 |
| 1,876,597 | A | | 9/1932 | Bennett | |
| 2,042,890 | A | * | 6/1936 | Fulenwider et al. | 52/530 |
| 2,117,014 | A | * | 5/1938 | Black | 52/549 |
| 2,202,830 | A | * | 6/1940 | Bussey | 52/534 |
| 3,312,031 | A | * | 4/1967 | Berg | 52/530 |
| 3,363,380 | A | | 1/1968 | Merrill | |
| 3,579,940 | A | | 5/1971 | Greenleaf | |
| 3,977,141 | A | * | 8/1976 | Peters | 52/313 |
| 4,262,462 | A | * | 4/1981 | Melbye | 52/98 |
| 4,279,106 | A | * | 7/1981 | Gleason et al. | 52/100 |
| 4,637,191 | A | * | 1/1987 | Smith | 52/522 |
| 5,502,940 | A | * | 4/1996 | Fifield | 52/309.12 |
| 6,178,703 | B1 | * | 1/2001 | Noone et al. | 52/100 |
| 6,205,742 | B1 | | 3/2001 | Hahn | |
| 6,233,895 | B1 | * | 5/2001 | Evans et al. | 52/518 |
| 6,510,664 | B2 | | 1/2003 | Kupczyk | |
| D518,902 | S | | 4/2006 | Beetler et al. | |
| 7,246,474 | B2 | | 7/2007 | Dombek et al. | |
| 7,320,774 | B2 | * | 1/2008 | Simmons et al. | 264/333 |
| 2005/0183370 | A1 | | 8/2005 | Cripps | |

FOREIGN PATENT DOCUMENTS

| | | |
|---|---|---|
| JP | 2006-188900 | 7/2006 |

* cited by examiner

*Primary Examiner* — Michael Safavi
(74) *Attorney, Agent, or Firm* — Buchanan Ingersoll & Rooney PC

(57) ABSTRACT

A roofing system includes at least one row of tiles extending across a surface in a row direction, a first tile of the at least one row of tiles including a rain lock adapted to interlock with a second tile adjacent to and within the same row as the first tile, wherein the rain lock has a lower end, an upper end, and a weakened portion proximate the lower end to allow for removal of a predetermined portion of the rain lock. The second tile of the roofing system includes a corner at the upper end of the rain lock of the first tile, the corner including a notch and a second weakened portion to allow for lengthening of the notch.

13 Claims, 6 Drawing Sheets

INTERLOCKING TILES EMPLOYING ADJUSTABLE RAIN LOCK

FIELD OF THE INVENTION

The present invention relates to a roofing system utilizing interlocking tiles. In particular, the present invention relates to an improved roofing system utilizing tiles having an adjustable rain lock to allow for selected tiles to be staggered down-roof.

DESCRIPTION OF RELATED ART

In the field of roofing, it is well-known to cover roofs with asphalt shingles. Roofing systems utilizing interlocking ceramic tiles have also been developed. A conventional interlocking ceramic tile roofing system is illustrated in FIGS. 1 and 2. Substantially flat, rectangular tiles 1 are attached to the roof deck in a series of parallel rows as shown in FIG. 1. Typically, the tiles 1 are placed from right to left, i.e., along the X axis of FIG. 1, with the leading edge 3 of each successive tile 1 within the row interlocking with the trailing edge 6 of the previous tile 1 as discussed in more detail below. Each successive row is laid out above the previous row, i.e., further up the roof deck relative to the Y axis of FIG. 1 (which is perpendicular to the X axis) than the previous row, with the lower edge 8 of each of the tiles 1 in the successive row interlocking with one or more tiles 1 of the previous row as discussed in more detail below. Once positioned, the upper surface 9 of each tile 1 faces generally toward the sky along the Z axis of FIG. 1 (which is perpendicular to the X axis and the Y axis).

Each tile 1 includes a rain lock 2 comprising a concave trough generally extending along the trailing edge 6 of the tile 1 and configured to face and fit below the leading edge 3 of the successive tile 1 within the row. Each rain lock 2 includes a free edge 4 extending from a lower end 19 of the rain lock 2 proximate the lower edge 8 of the tile to an upper end 20 of the rain lock 2 proximate the upper edge 7 of the tile 1.

Each tile 1 also includes a downwardly facing groove 10 extending along its lower surface and generally parallel and proximate to its leading edge 3. The free edge 4 of each rain lock 2 is designed to interlock with the groove 10 of the successive tile 1 within the row. Additionally, each tile 1 includes a vertical wall 13 coextensive with the upper edge 7 of the tile and extending across the upper end 20 of the rain lock 2, and a notch 14 in the corner defined by the intersection of the upper edge 7 and the leading edge 3.

Each tile 1 also includes a flange 5 positioned along its lower edge 8 and directed generally toward the upper surface 9 of at least one tile 1 in the previous row. As shown in FIG. 2, the lower end 19 of each rain lock 2 abuts with the flange 5 of the successive tile 1 within the row. This abutting engagement operates in tandem with the interlocking of the free edge 4 of the rain lock 2 with the groove 10 of the successive tile 1 within the row to prevent rain water from reaching the roof deck.

In certain circumstances, for aesthetic or other reasons, it is desirable to stagger one or more tiles 1 down-roof along the Y axis relative to adjacent tiles 1 within the row. However, the abutting engagement of the rain lock 2 of the tile 1 to be staggered with the flange 5 of the successive tile 1 within the row prevents such staggering, and accordingly it is necessary to cut a portion of the rain lock 2 off at its lower end 19, e.g., with a wet saw, in order to permit such staggering. The modified tile 1, i.e., with the portion removed, can be positioned down-roof along the Y axis relative to adjacent tiles 1 within the row a distance equal to the length of the removed portion of the rain lock 2, whereupon the shortened rain lock 2 abuts the flange 5.

Furthermore, the vertical wall 13 abuts a portion of notch 14 of the successive tile 1 within the row. However, such abutment also blocks the above-discussed staggering of the tile 1. Thus, it is also necessary to cut out a portion of the successive tile 1 within the row, e.g., with a wet saw, so as to lengthen the notch 14 of the successive tile 1 in the Y direction, thus allowing for the above-discussed staggering of the tile 1.

Accordingly, it is possible to stagger certain tiles in the prior art roofing system. However, the need remains for a roofing system that allows for the tiles to be conveniently modified for staggering during installation, e.g., without requiring the use of a power tool such as a wet saw.

SUMMARY

An interlocking roof tile comprises a rain lock having a lower end proximate a first corner of the tile and an upper end proximate a second corner of the tile, wherein the rain lock comprises a trough and includes a first weakened portion proximate the lower end to allow for removal of a predetermined portion of the rain lock.

An interlocking roof tile further comprises a third corner diagonally opposed to the first corner having a notch and a second weakened portion to allow for lengthening of the notch.

A roofing system comprises at least one row of tiles extending across a surface in a row direction, a first tile of the at least one row of tiles comprising a rain lock adapted to interlock with a second tile adjacent to and within the same row as the first tile, wherein the rain lock has a lower end, an upper end, and a weakened portion proximate the lower end to allow for removal of a predetermined portion of the rain lock.

The second tile of the roofing system comprises a corner proximate the upper end of the rain lock of the first tile, the corner comprising a notch and a second weakened portion to allow for lengthening of the notch.

A method of tiling a roof comprises positioning at least one row of tiles across a surface in a row direction, a first tile of the at least one row of tiles comprising a rain lock adapted to interlock with a second tile adjacent to and within the same row as the first tile, said rain lock having a lower end, an upper end, and a weakened portion proximate the lower end to allow for removal of a predetermined portion of the rain lock; removing the predetermined portion of the rain lock; and staggering the first tile in the down-roof direction relative to at least one adjacent tile.

The method of tiling a roof further comprises lengthening a notch of the second tile by removing a predetermined portion of the second tile defined by a second weakened portion.

BRIEF DESCRIPTION OF THE DRAWING FIGURES

DETAILED DESCRIPTION OF THE PREFERRED EMBODIMENTS

Figure 1:
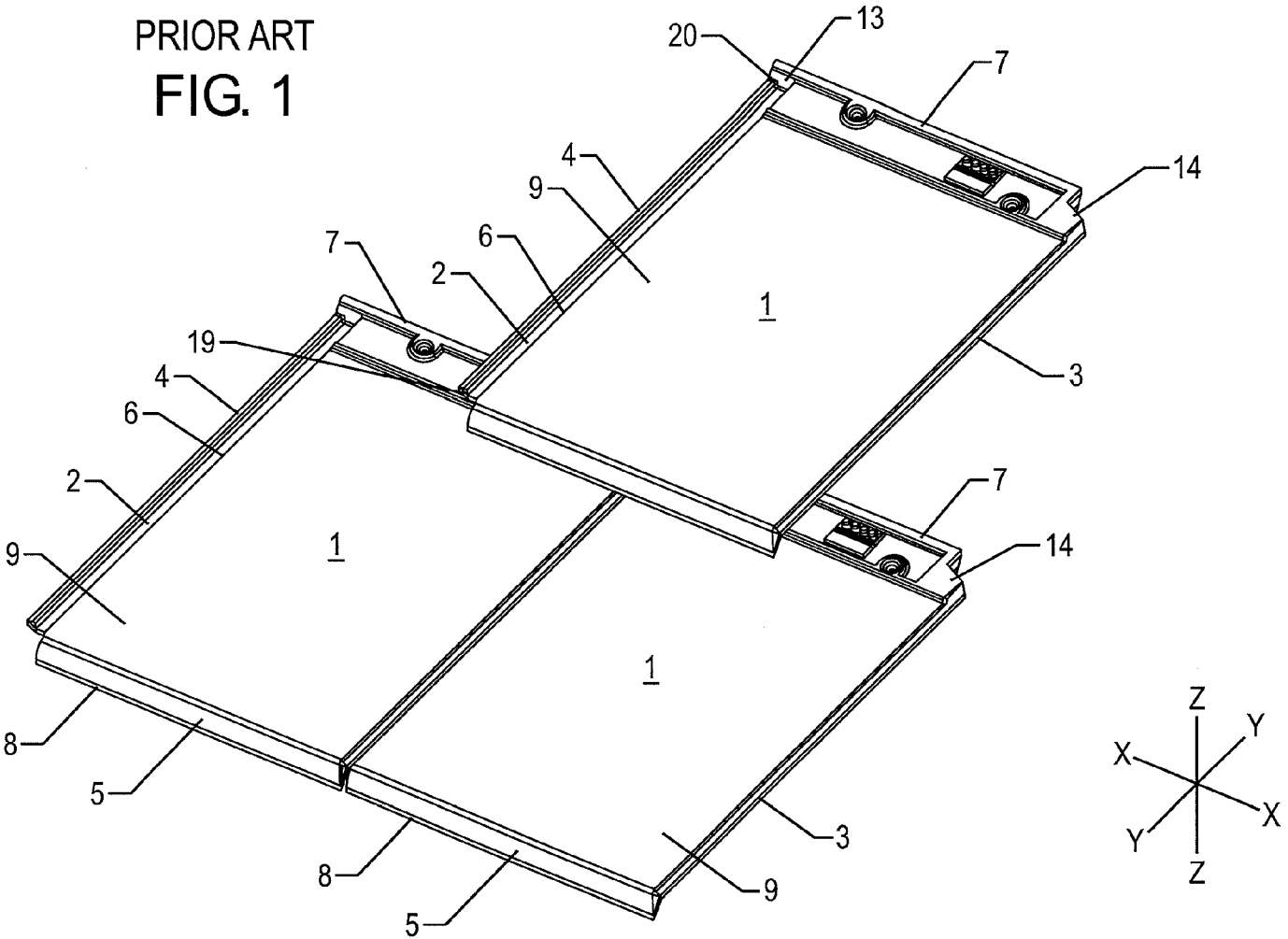
PRIOR ART FIG. 1
FIG. 1 is a perspective view of prior art roofing tiles.
Figure 2:
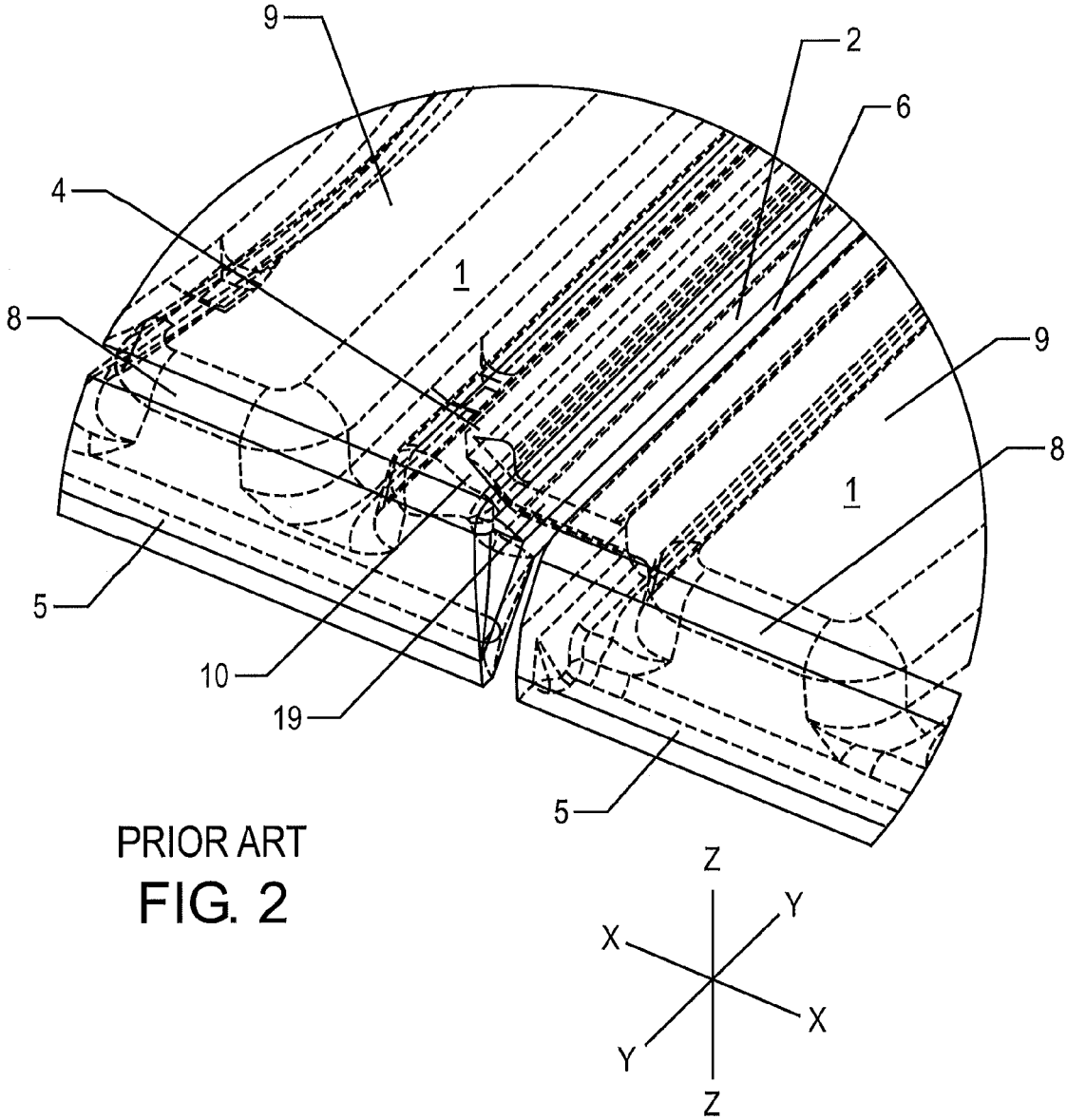
PRIOR ART FIG. 2
FIG. 2 is a detail view of area A of FIG. 1.
Figure 3:
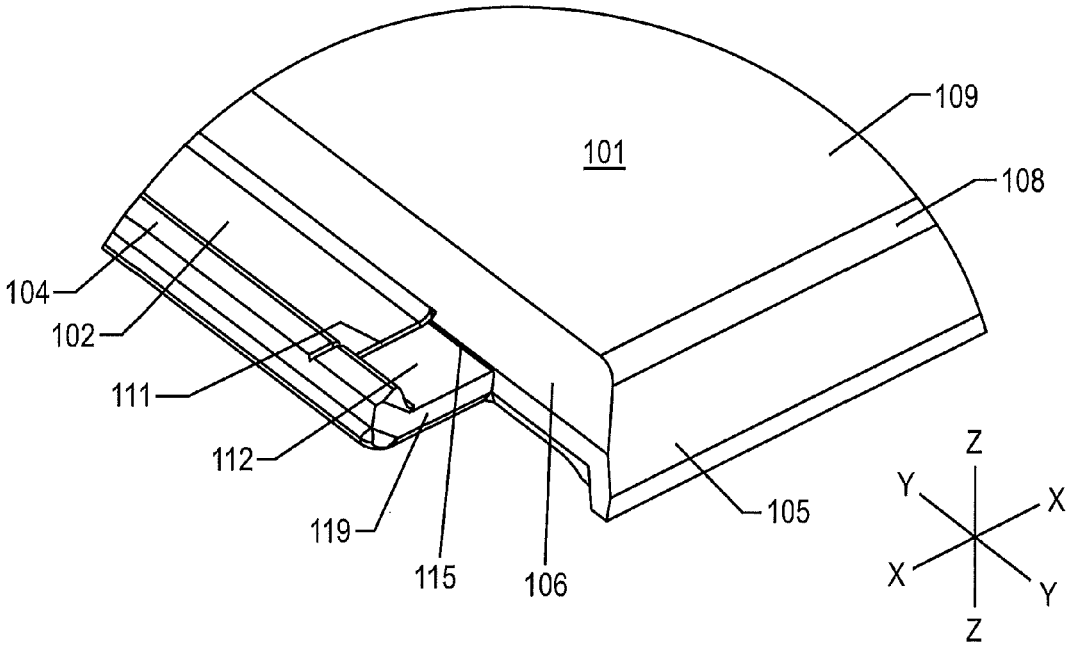
FIG. 3 is a perspective view of a rain lock according to an embodiment of the invention.
Figure 4:
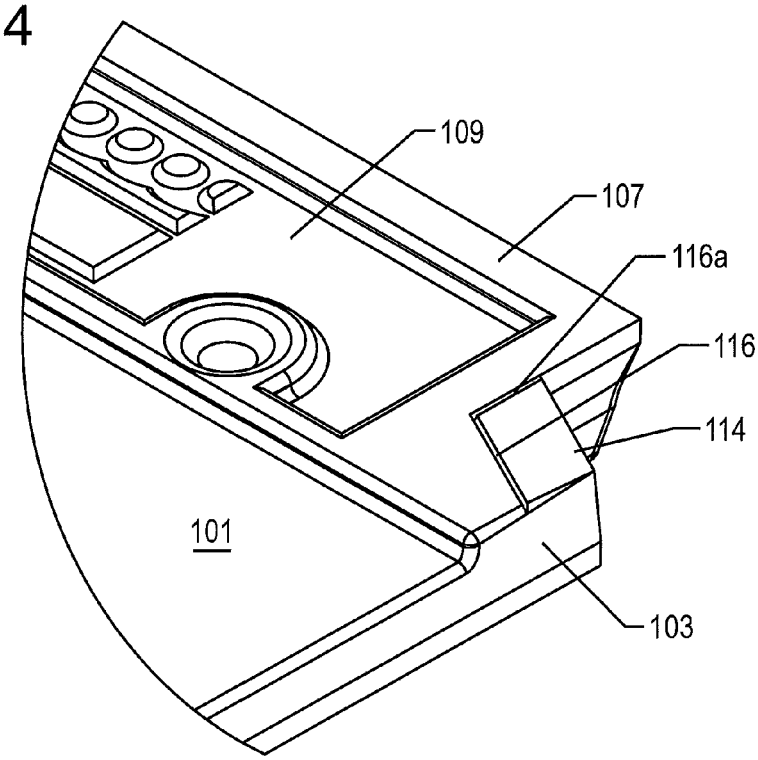
FIG. 4 is a perspective view of a notch and a notch score line according to an embodiment of the invention.
Figure 5:
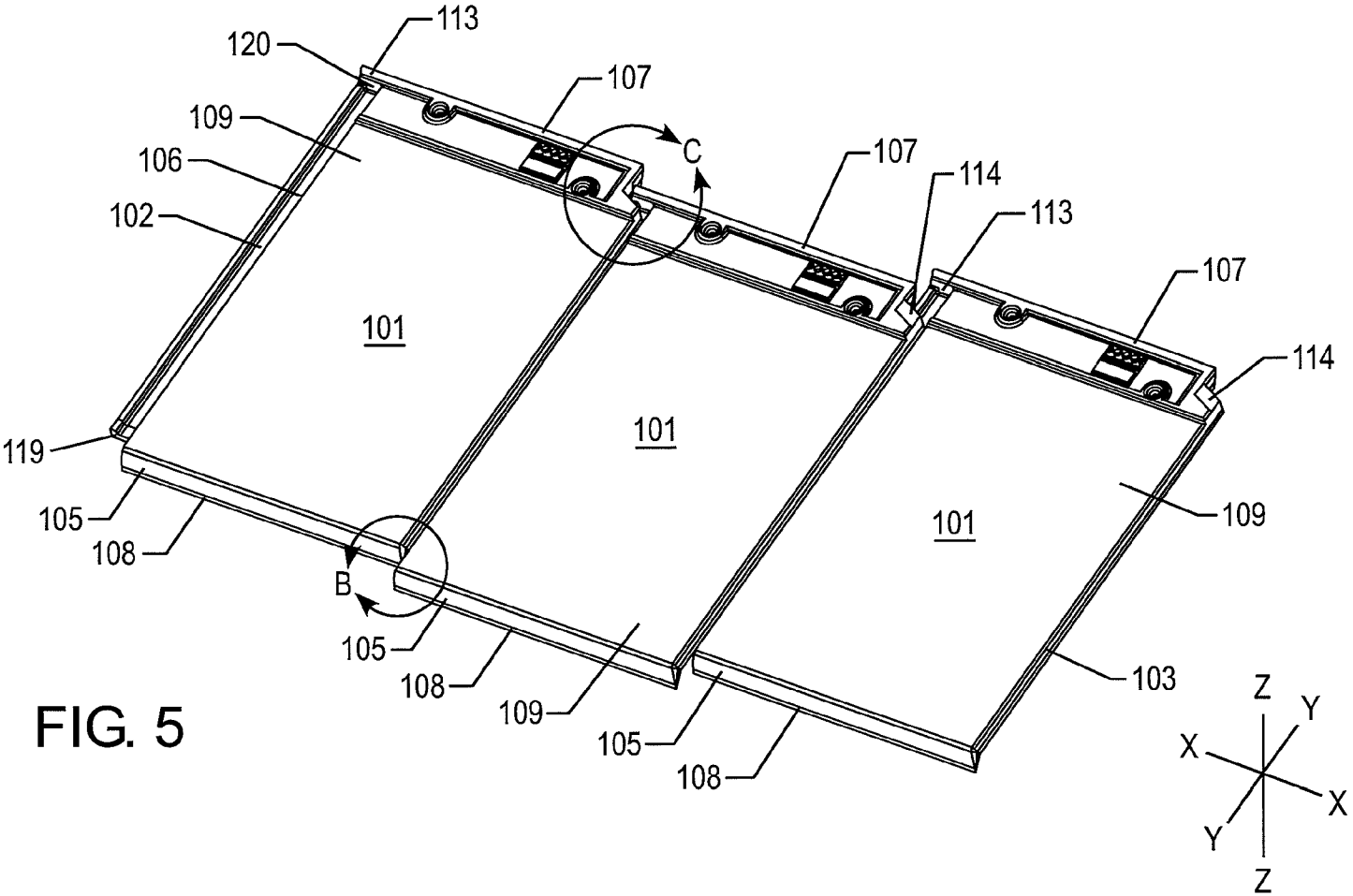
FIG. 5 is a perspective view of roofing tiles according to an embodiment of the invention.

An interlocking ceramic tile roofing system according to an embodiment of the invention is illustrated in FIGS. 3 through 7. Substantially flat, rectangular tiles 101 are attached to the roof deck in a series of parallel rows as shown in FIG. 5. Typically, the tiles 101 are placed from right to left, i.e., along the X axis of FIG. 5, with the leading edge 103 of each successive tile 101 within the row interlocking with the trailing edge 106 of the previous tile 101 as discussed in more detail below. Each successive row is laid out above the previous row, i.e., further up the roof deck relative to the Y axis of FIG. 5 (which is perpendicular to the X axis) than the previous row, with the lower edge 108 of each of the tiles 101 in the successive row interlocking with one or more tiles 101 of the previous row as discussed in more detail below. Once positioned, the upper surface 109 of each tile 101 faces generally toward the sky along the Z axis of FIG. 5 (which is perpendicular to the X axis and the Y axis).

Each tile 101 includes a rain lock 102 comprising a concave trough generally extending along the trailing edge 106 of the tile 101 and configured to face and fit below the leading edge 103 of the successive tile 101 within the row. Each rain lock 102 includes a free edge 104 extending from a lower end 119 of the rain lock 102 proximate the lower edge 108 of the tile to an upper end 120 of the rain lock 102 proximate the upper edge 107 of the tile 101.

Each tile 101 also includes a downwardly facing groove 110 extending along its lower surface and generally parallel and proximate to its leading edge 103. The free edge 104 of each rain lock 102 is designed to interlock with the groove 110 of the successive tile 101 within the row. Additionally, each tile 101 includes a vertical wall 113 coextensive with the upper edge 107 of the tile 101 and extending across the upper end 120 of the rain lock 102, and a notch 114 in the corner defined by the intersection of the upper edge 107 and the leading edge 103.

Figure 6:
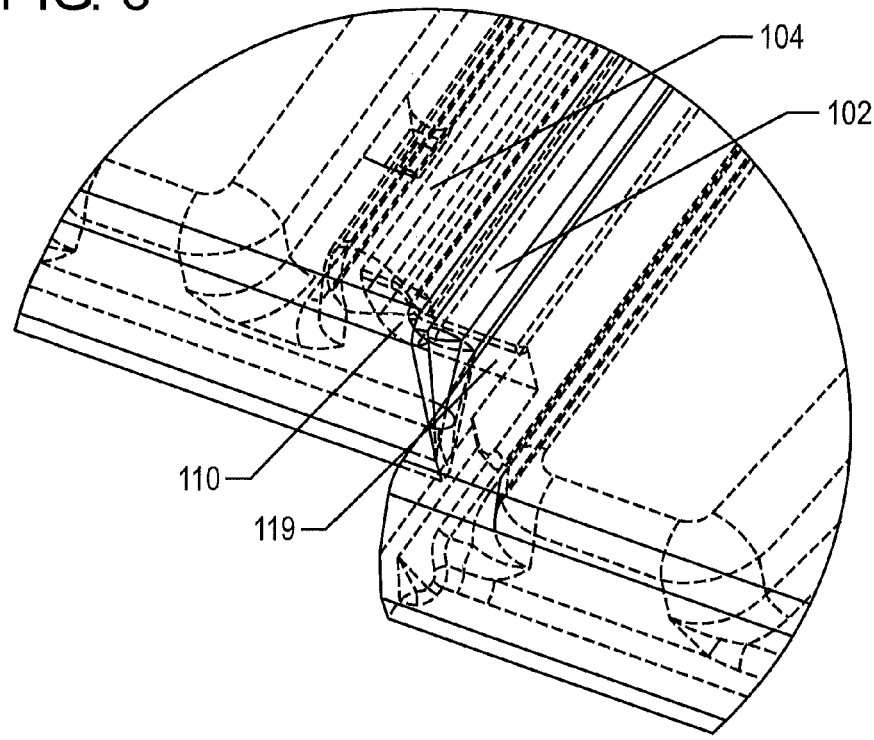
FIG. 6 is a detail view of area B of FIG. 5.

Each tile 101 also includes a flange 105 positioned along its lower edge 108 and directed generally toward the upper surface 109 of at least one tile 101 in the previous row. As shown in FIG. 6, the lower end 119 of each rain lock 102 abuts with the flange 105 of the successive tile 101 within the row. This abutting engagement operates in tandem with the interlocking of the free edge 104 of the rain lock 102 with the groove 110 of the successive tile 101 within the row to prevent rain water from reaching the roof deck.

In certain circumstances, for aesthetic or other reasons, it is desirable to stagger one or more tiles 101 down-roof along the Y axis relative to adjacent tiles 101 within the row. However, the abutting engagement of the rain lock 102 of the tile 101 to be staggered with the flange 105 of the successive tile 101 within the row prevents such staggering, and accordingly it is necessary to remove a portion of the rain lock 102 at its lower end 119 in order to permit such staggering. The modified tile 101, i.e., with the portion removed, can be positioned down-roof along the Y axis relative to adjacent tiles 1 within the row a distance equal to the length of the removed portion of the rain lock 102, whereupon the shortened rain lock 102 abuts the flange 105.

In order to provide for convenient removal of a portion of the rain lock 102, a weakened portion comprising one or more score lines is provided. Score line 111 can be provided across the rain lock 102 near its lower end 119 as shown in FIG. 3. The position of the score line 111 defines a predetermined portion 112 of the rain lock 102, i.e., the portion of the rain lock 102 between the score line 111 and the lower end 119 of the rain lock 102. Alternatively, or in addition, a score line 115 can be provided at the intersection of the predetermined portion 112 and the trailing edge 106 as shown in FIG. 3. The width and depth of the score lines 111 and 115 are selected such that the predetermined portion 112 of the rain lock 102 remains attached to the tile 101 during normal usage, but can be conveniently removed from the tile 101 via a hand tool, e.g., pliers, if it is desired to stagger the tile 101.

Figure 7:
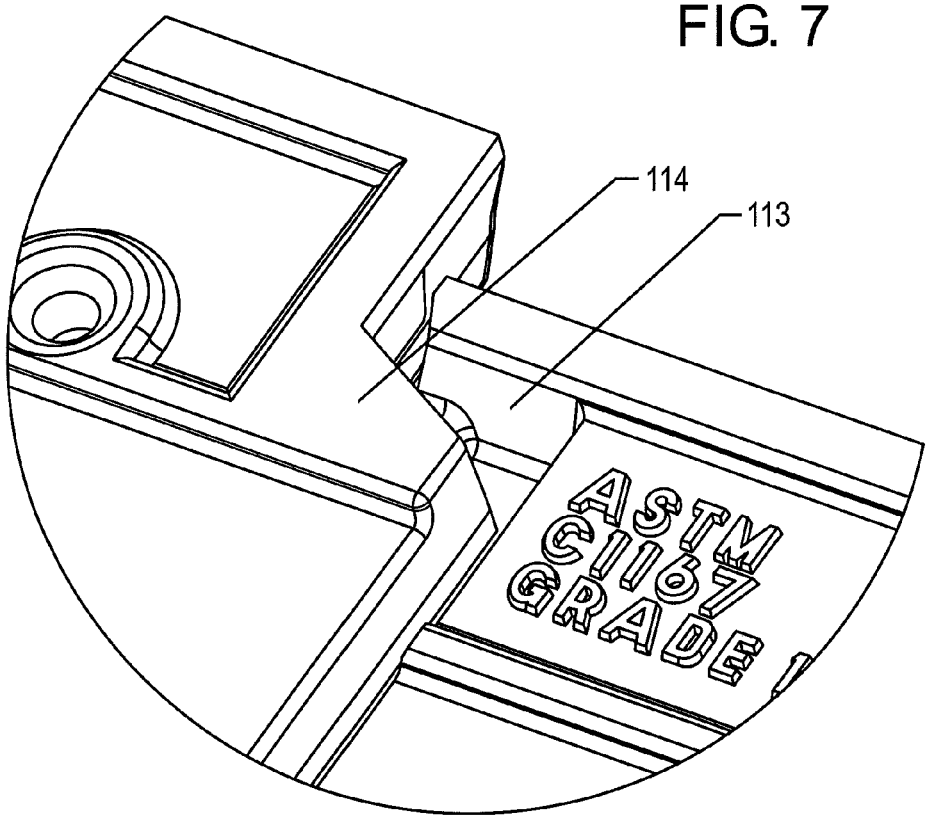
FIG. 7 is a detail view of area C of FIG. 5.

Furthermore, abutment of the vertical wall 113 with a portion of notch 114 of the successive tile 101 within the row would block the above-discussed staggering of the tile 101. Accordingly, the notch 114 is provided having a lengthened dimension in the Y direction such that the vertical wall 113 of a tile 101 does not abut the notch 114 of the successive tile 101 until after staggering of the tile 101. This allows for staggering of a tile 101 as shown in FIG. 7 without the need for the notch 114 of the successive tile 101 to be modified on-site.

Alternatively, instead of providing a lengthened dimension in the Y direction of the notch 114, the notch 114 can be provided with a notch score line 116 extending across a portion of the tile 101 as shown in FIG. 4. The notch score line 116 is located such that when a portion of a successive tile 101 between the notch score line 116 and the notch 114 is removed, the notch 114 is lengthened in the Y direction such that the vertical wall 113 of a tile 101 does not abut the notch 114 of the successive tile 101 until after staggering of the tile 101. Secondary notch score line **116*a* joining an end of notch score line 116 to the inside corner of notch 114 can also be provided as shown in FIG. 4. The width and depth of notch score line 116 (and secondary notch score line 116*a*, if provided) is selected such that the portion of a successive tile 101 between the notch score line 116 and the notch 114 remains attached to the successive tile 101 during normal usage, but can be conveniently removed from the successive tile 101 via a hand tool, e.g., pliers, if it is desired to stagger a tile 101**.

The invention has been described in detail with particular reference to preferred embodiments thereof, but it will be understood that variations and modifications can be effected within the spirit and scope of the invention.

What is claimed is:

1. An interlocking roof tile, comprising:

an upper surface having a substantially flat portion;

a lower surface; and a rain lock having a lower end proximate a first corner of the tile and an upper end proximate a second corner of the tile, wherein the rain lock comprises a trough adjacent the substantially flat portion of the upper surface of the tile and includes a first weakened portion which is proximate the lower end and which extends across the trough to a side edge which connects the substantially flat portion of the upper surface to the trough, to allow for removal of a predetermined portion of the rain lock including a predetermined portion of the trough.

2. The interlocking roof tile of claim 1, wherein the first weakened portion comprises at least one score line.

3. The interlocking roof tile of claim 1, further comprising a third corner diagonally opposed to the first corner, wherein the third corner comprises a notch.

4. The interlocking roof tile of claim 3, further comprising a second weakened portion to allow for lengthening of the notch.

5. The interlocking roof tile of claim 4, wherein the second weakened portion comprises at least one score line.

6. A roofing system comprising at least one row of tiles extending across a surface in a row direction, a first tile of the at least one row of tiles comprising an upper surface having a substantially flat portion, a lower surface, and a rain lock adapted to interlock with a second tile adjacent to and within the same row as the first tile, wherein the rain lock comprises a trough adjacent the substantially flat portion of the upper surface of the tile and has a lower end, an upper end, and a weakened portion which is proximate the lower end and which extends across the trough to the substantially flat portion of the upper surface to the trough, to a side edge which connects allow for removal of a predetermined portion of the rain lock including a predetermined portion of the trough.

7. The roofing system of claim 6, wherein the lower end of the first tile is adapted to abut a flange of the second tile.

8. The roofing system of claim 6, wherein the weakened portion comprises at least one score line.

9. The roofing system of claim 6, wherein removal of the predetermined portion of the lower end allows for staggering of the first tile in a down-roof direction perpendicular to the row direction.

10. The roofing system of claim 6, wherein the second tile comprises a corner proximate the upper end of the rain lock of the first tile, the corner comprising a notch which allows for staggering of the first tile in a down-roof direction perpendicular to the row direction.

11. The roofing system of claim 6, wherein the second tile comprises a corner proximate the upper end of the rain lock of the first tile, the corner comprising a notch and a second weakened portion to allow for lengthening of the notch.

12. The roofing system of claim 11, wherein the second weakened portion comprises at least one score line.

13. The roofing system of claim 11, wherein lengthening of the notch allows for staggering of the first tile in a down-roof direction perpendicular to the row direction.

* * * * *